United States Patent [19]

Pöll et al.

[11] Patent Number: 4,718,963

[45] Date of Patent: Jan. 12, 1988

[54] METHOD FOR PRODUCING A DECORATIVE MATERIAL

[75] Inventors: Martin Pöll, Fritzens; Serge Amstutz, Tirol, both of Austria

[73] Assignee: D. Swarovski & Co., Austria

[21] Appl. No.: 819,266

[22] Filed: Jan. 16, 1986

[30] Foreign Application Priority Data

Jan. 21, 1985 [DE] Fed. Rep. of Germany ..... 3501815

[51] Int. Cl.[4] ..... B44C 3/02

[52] U.S. Cl. ..... 156/232; 156/235; 156/242; 156/247; 156/249; 156/283; 156/344

[58] Field of Search ..... 156/230, 231, 232, 233, 156/234, 235, 237, 238, 239, 240, 241, 242, 245, 246, 247, 249, 306.3, 344, 283, 291

[56] References Cited

U.S. PATENT DOCUMENTS 2,587,594 3/1952 Chavannes et al. ..... 156/232
3,351,510 11/1967 Harris ..... 156/232
4,139,613 2/1979 Hefele ..... 156/291
4,308,310 12/1981 Arnold et al. ..... 156/249
4,330,352 5/1982 Grimes et al. ..... 156/235

FOREIGN PATENT DOCUMENTS 155372 9/1982 Japan ..... 156/247

*Primary Examiner*—Caleb Weston
*Attorney, Agent, or Firm*—Bacon & Thomas

[57] ABSTRACT

A method for producing a multilayer decorative material, wherein a die is provided having one or more raised and depressed areas, the raised areas corresponding to the desired shape of the decorative material; a melt adhesive layer is applied to the raised areas across their surface; an effect layer is applied to the melt adhesive layer; a protective layer or a color lacquer layer is optionally applied to the effect layer; and the multilayer decorative material consisting of the adhesive, effect layer and optional protective layer is removed as a unit from the raised areas, for example by a self-adhesive sheet.

8 Claims, 11 Drawing Figures

12
13
1
2

3

4

6
5

7

8

METHOD FOR PRODUCING A DECORATIVE MATERIAL

BACKGROUND OF THE INVENTION

The present invention relates to a method for producing a decorative material.

The invention is based on the problem of providing a simple and economical method for producing a decorative material by which different-shaped and different types of decorative materials can easily be produced.

The invention is based on the finding that this problem can be solved by building up the decorative material on a die whose design corresponds to the desired shape of the decorative material, and then transferring it to the article to be decorated.

The object of the invention is a method for producing a decorative material characterized in that (a) a die is provided having one or more raised and depressed areas, the raised areas corresponding to the desired shape of the decorative material, (b) a melt adhesive layer is applied to the raised areas across their surface, (c) an effect layer is applied to the melt adhesive layer, (d) a protective layer or a color lacquer layer is optionally applied to the effect layer, and (e) the decorative material is removed from the raised areas for example by using a self-adhesive sheet.

The die is to be made of a material from which the melt adhesive layer can easily be detached. Dies made of silicon rubber have proved particularly useful for this purpose. But other materials, such as synthetic resins and metals, and appropriately coated materials may also be used.

The melt adhesive layer should be applied evenly across the surface of the raised areas of the die, whereby melt adhesive may also go into the depressed areas of the die. The melt adhesive may be applied in a variety of ways, for example strewn on or sprayed on. It is particularly advantageous to strew on particulate material, i.e. a powdered melt adhesive, across the surface, then melt the particles by supplying heat, for example by infrared radiation, and finally smooth the layer, for example by a roller.

A heat-resistant film-forming synthetic layer is preferably applied as the next layer to the melt adhesive layer.

The effect layer is then applied to the synthetic layer or the melt adhesive layer. The effect layer is preferably a vacuum metallized (vapor deposition) layer. A protective layer which is preferably a transparent protective varnish layer may optionally be applied to this effect layer. Alternatively, a color lacquer layer may be applied.

The decorative material is removed from the raised areas of the die with at least the melt adhesive exposed. This is best effected using a self-adhesive sheet applied to the layer furthest from the die. The decorative material is applied from this self-adhesive sheet to the desired articles, for example textiles.

Conventional sheets are suitable as self-adhesive sheets, whereby transparent sheets are preferred since this facilitates the application.

The invention shall be explained in more detail in the following with reference to the drawing, which shows an exemplary embodiment.

DETAILED DESCRIPTION

Figures 1A, 1B, 1C, 1D, 1E, 1F:
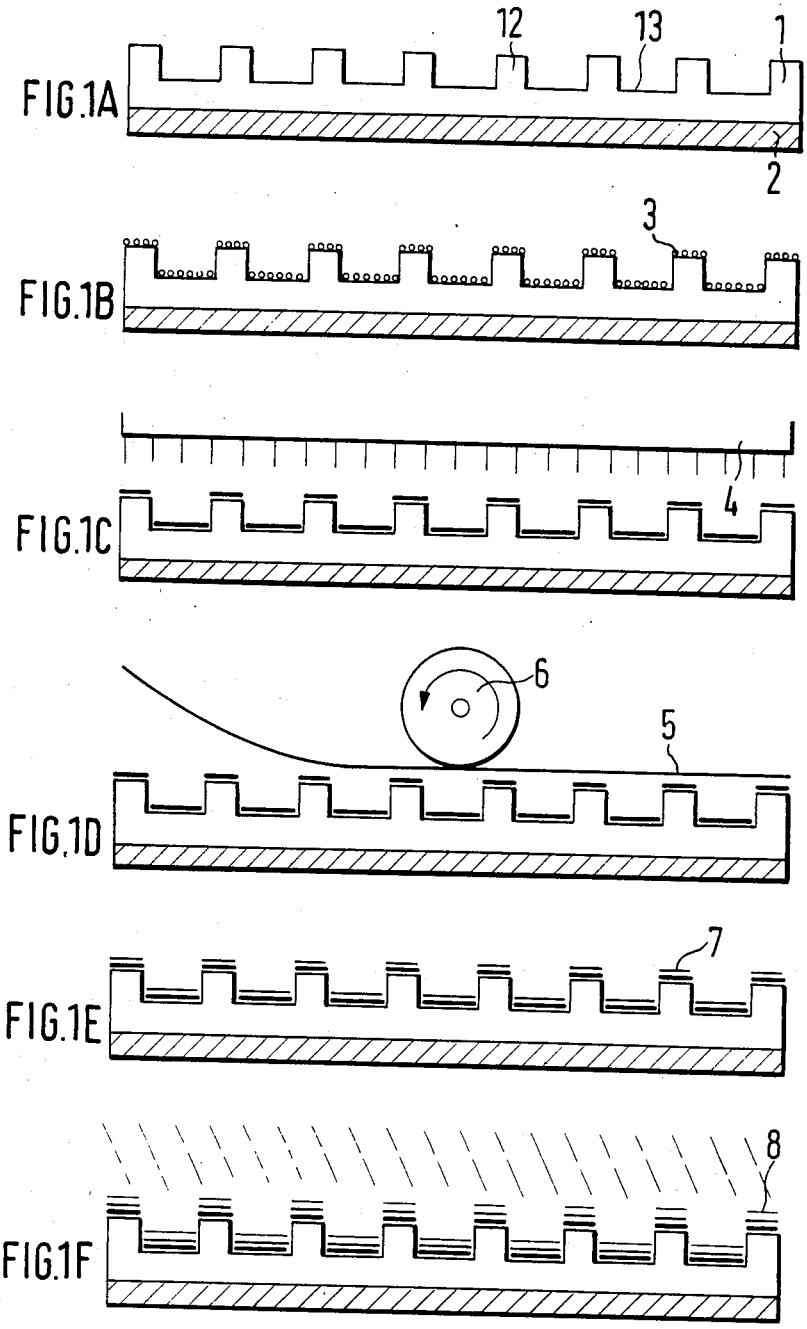
FIG. 1 (a–h, j and k) shows the various method steps in chronological order.

FIG. 1*a* shows die 1 on an appropriate die base 2 with raised areas 12 and depressed areas 13. Raised areas 12 are shaped in accordance with the desired shape of the individual elements of the decorative material. No limits are set on these shapes. Examples are: a great number of discrete individual elements, such as round dots, squares, etc., adjacent stripes, large-surface representations or pictorial motifs executed either in lines or in areas.

According to a preferred variant of the method, particulate melt adhesive 3 is strewn evenly across the surface of the entire die, as shown in FIG. 1*b*.

The melt adhesive is then melted—FIG. 1*c*—thereby forming a continuous melt adhesive layer. This is effected by supplying heat, preferably by means of an infrared projector 4.

The melt adhesive layer is then smoothed. For this purpose a polytetrafluoroethylene sheet 5 may be applied, to which the melt adhesive does not stick, and a roller 6 conducted across it, as shown schematically in FIG. 1*d*.

FIG. 1*e* shows that a synthetic layer 7 is applied to the melt adhesive layer. This may be effected, for example, by spraying on or rolling on. Epoxy resins and thermosetting varnishes are particularly suitable.

Effect layer 8 is applied to synthetic layer 7 or directly to melt adhesive layer 3. This is preferably effected by vaporization. This step is shows in FIG. 1*f*.

Figure 1G:
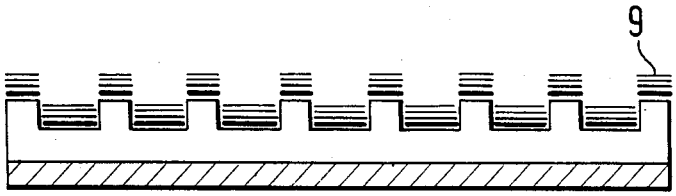

FIG. 1*g* shows the preferred step according to which a color lacquer layer 9 or optionally a colorless protective layer is applied to effect layer 8. This is effected by spraying on or preferably by rolling on.

Figure 1H:
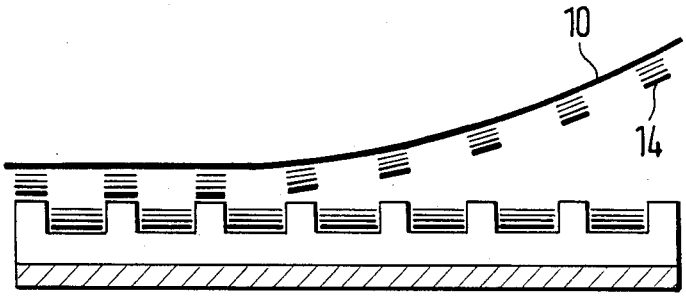

FIG. 1*h* shows how the decorative material, consisting of individual decorative elements 14, is removed by means of a self-adhesive sheet 10. The decorative material is now finished. The die is then cleaned.

Figure 1J:
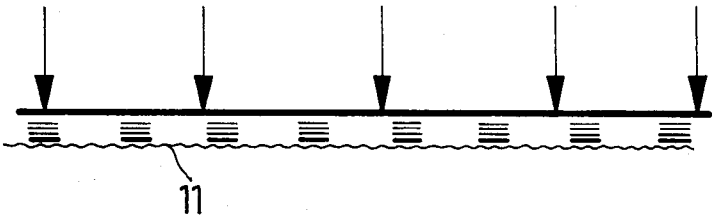

FIG. 1*j* schematically shows the decorative material being ironed onto a textile material 11. Melt adhesive layer 3 thereby connects with the textile material.

Figure 1K:
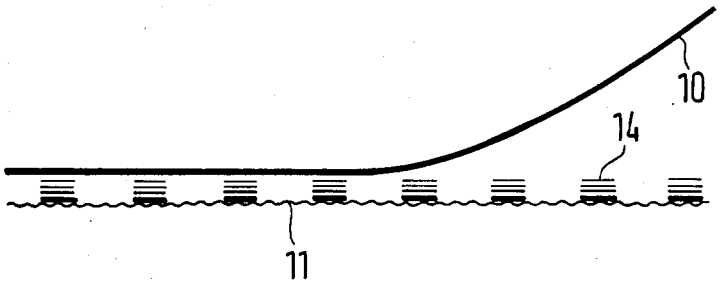

After ironing, self-adhesive sheet 10 is removed, as shown in FIG. 1*k*. Decorative elements 14 are now applied to textile material 11.

Figure 2:
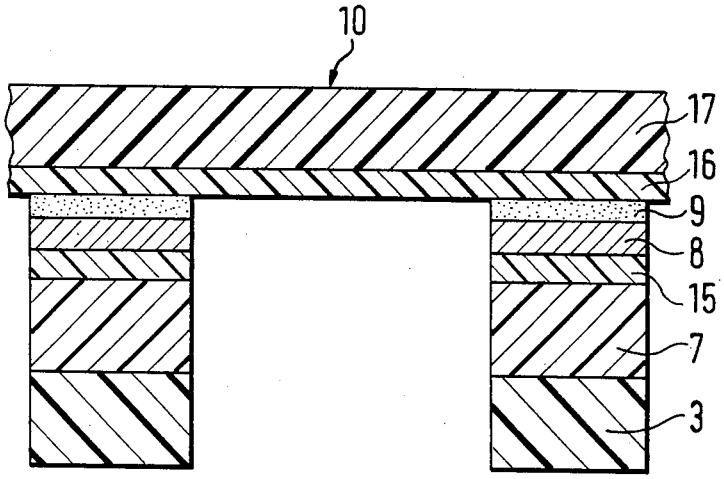
FIG. 2 shows the finished decorative material including the self-adhesive sheet

FIG. 2 illustrates a preferred embodiment of the inventively produced decorative material. A single decorative element 14 is shown connected to self-adhesive sheet 10.

All known melt adhesives are suitable for melt adhesive layer 3 which ensure good adhesion between the decorative material and the articles to which it is to be applied. Examples of such melt adhesives are polyamides, polyvinylacetate, polyester resins, epoxy resins, isocyanates and aminoplastics. Melt adhesives on the basis of thermoplastic polyamide resins are particularly preferred. The thickness of the melt adhesive layer may vary within wide limits depending on the application. It is preferably within a range of 20 and 100 μm and in particular between 50 and 80 μm.

Synthethic layer 7 should be characterized by heat-resistance and stability of shape. The heat resistance must be high enough so that when the melt adhesive layer is activated the synthetic layer is not impaired and retains its shine. The stability of shape is important in order that the structure of the fabric is not pressed through when the decorative material is applied to the textile. This function of the synthetic layer may also be fulfilled by a sheet of aluminum foil. The synthetic layer may be transparent or colored, for example yellow, in order to achieve a golden effect. Epoxy resins or polyester are preferably used as synthetic materials. Their thickness is preferably within a range of 10 to 30 μm, but larger thicknesses up to 100 μm may also be used if desired.

The overall thickness of the decorative material is generally selected so as to be as thin as possible in order to impair the properties of the textile and thus its wearing properties as little as possible.

Effect layer 8 is preferably a metallic effect layer. It consists in particular of a vacuum metallized layer. The production of such coatings of metal, metallic oxides or metallic salts, which may be effected for example by thermal evaporation in a vacuum, electron-beam sputtering or cathodic sputtering, is known. These layers are generally very thin and are in a magnitude of 0.5 to 5 μm, in particular 2 to 4 μm. The use of appropriate materials or a multilayer evaporation may serve to give the vaporized layer a certain color, in particular the characteristic interference colors. This design may be used to achieve special aesthetic efforts.

Layers of paint, in particular synthetic varnish layers and acrylic paint layers, are also suitable as effect layers.

A further melt adhesive layer 15 may optionally be provided between synthetic layer 7 and effect layer 8 in order to ensure an improved bond between the above-mentioned layers.

A protective layer 9 is preferably applied to the effect layer. This protective layer is usually a transparent protective varnish. It mainly has the function of protecting the effect layer, in particular of making the decorative material resistent to washing and cleaning.

The protective layer may also be colored in order to achieve special aesthetic effects. The protective layer must not be thermally activatable, i.e. when the melt adhesive layer is activated the protective layer must not be impaired. Epoxy varnishes are particularly suitable.

Layers of primer may optionally be present between the various layers so as to contribute in particular to an improved bond between the layers.

Self-adhesive sheet 10 used for removing, transferring and applying is of the conventional type and preferably consists of a transparent polyester sheet 17 with adhesive layer 16. Self-adhesive sheet 10 must be heatresistant.

We claim:

1. A method for producing a multilayer decorative material including at least a melt adhesive layer and an effect layer comprising:

(a) providing a die having one or more raised and depressed areas, the raised areas corresponding to the desired shape of the deorative material and the die being made of a material from which a melt adhesive layer is easily detachable;

(b) applying the melt adhesive layer to the raised areas across their surface;

(c) applying the effect layer to the melt adhesive layer;

(d) providing a thermally non-activatable transparent protective layer or color lacquer layer on the effect layer;

(e) removing from the raised areas of the die the melt adhesive layer, the effect layer and the protective layer or color lacquer layer as a multilayer decorative material with a least the melt adhesive layer exposed.

2. The method according to claim 1 wherein the die is made of silicon rubber.

3. The method according to claim 1 wherein the melt adhesive layer is strewn on as a particulate material across the die surface, melted and smoothed.

4. The method according to claim 1 wherein a heat-resistant synthetic layer is applied to the melt adhesive layer before the effect layer is applied.

5. The method according to claim 1 wherein the effect layer is formed by vaporization and deposition.

6. The method according to claim 1 wherein the transparent protective layer is a varnish layer.

7. The method according to claim 1 wherein the multilayer decorative material is removed from the raised areas of the die by means of a self-adhesive sheet applies to the layer furthest from the die.

8. The method according to claim 7, wherein the self-adhesive sheet is transparent.

* * * * *